United States Patent [19]

Milluzzi

[11] Patent Number: 4,906,184

[45] Date of Patent: Mar. 6, 1990

[54] LONG LIFE COVER FOR HEAT CHAMBER

[75] Inventor: Robert Milluzzi, Brecksville, Ohio

[73] Assignee: Schaefer Brothers Incorporated, Cleveland, Ohio

[21] Appl. No.: 280,918

[22] Filed: Dec. 7, 1988

[30] Foreign Application Priority Data

Dec. 10, 1987 [GB] United Kingdom ..... 8728938

[51] Int. Cl.[4] ..... F27D 1/18

[52] U.S. Cl. ..... 432/250; 110/173 A; 110/336; 432/237

[58] Field of Search ..... 432/250, 237, 242; 110/173 A, 336

[56] References Cited

U.S. PATENT DOCUMENTS

| | | | |
|---|---|---|---|
| 3,853,077 | 12/1974 | Malovich | 432/250 |
| 3,854,262 | 12/1974 | Brady | 110/173 A |
| 4,406,619 | 9/1983 | Oldengott | 432/250 |
| 4,418,107 | 11/1983 | Yost | 432/237 |
| 4,524,702 | 6/1985 | Miller et al. | 110/173 A |
| 4,530,441 | 7/1985 | Miller et al. . | |
| 4,580,974 | 4/1986 | Brashler | 110/173 A |
| 4,597,341 | 7/1986 | Suey | 432/250 |
| 4,640,202 | 2/1987 | Schraff et al. | 432/250 |
| 4,721,461 | 1/1988 | Falk | 432/250 |

FOREIGN PATENT DOCUMENTS

| | | |
|---|---|---|
| 079804 | 5/1983 | European Pat. Off. . |
| 170622 | 2/1986 | European Pat. Off. . |
| 1259510 | 1/1968 | Fed. Rep. of Germany . |
| 1758464 | 2/1971 | Fed. Rep. of Germany . |

*Primary Examiner*—Henry C. Yuen

*Attorney, Agent, or Firm*—Nixon & Vanderhye

[57] ABSTRACT

A method and means of heat insulating the opening in a heat chamber, e.g., a soaking pit, comprises applying a cover including an inside lining of ceramic fibers, under a load which is selected so that the fibers contact a peripheral wall of the opening under a pressure which is sufficient to form a seal with the wall but insufficient to cause the fibers to be crushed.

8 Claims, 1 Drawing Sheet

LONG LIFE COVER FOR HEAT CHAMBER

Figure 1:
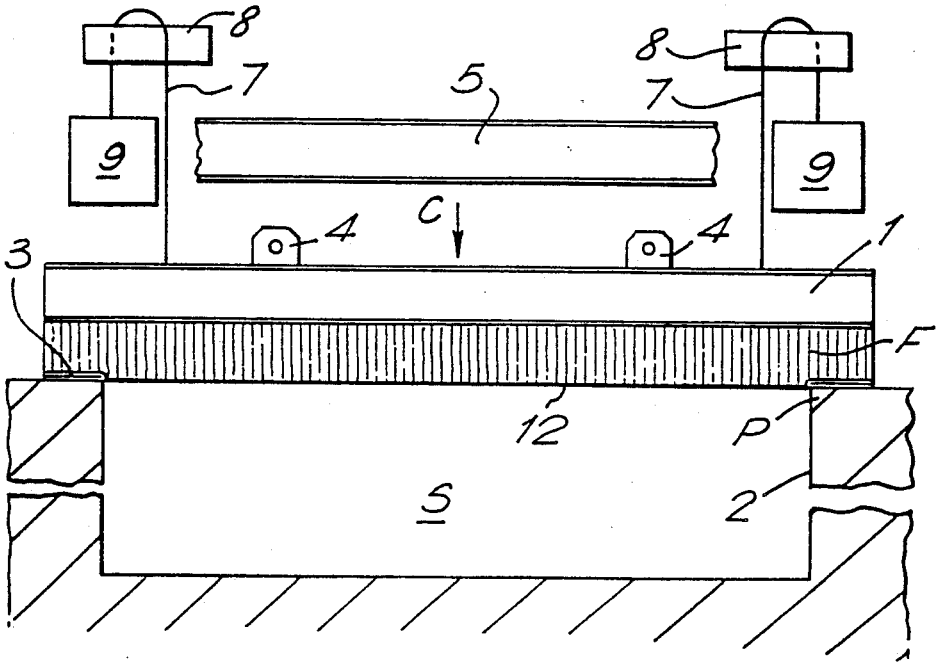

The invention relates to a cover or lid for a heat chamber, and more particularly, to such a cover having on its inner side a lining of ceramic fibres. This lining is made from individual lengths, modules or bodies of ceramic fibre, e.g., blankets which are held to the underside of the cover. Covers including such linings are disclosed, for example, in European Pat. No. 170622. For convenience, the word cover will be used to describe covers, lids or the like.

It is known to locate such a cover on top of a soaking pit at a steelmill, in order to contain heat therein. Unfortunately, the ceramic fibre lining does not last, and it is rare for such a lining to last more than one month before it needs to be replaced by another ceramic fibre lining. It has been recognized that at the high temperatures in the pit, the fibres undergo a chemical change and it is this which shortens their lives.

We have studied the reasons for the short life of the lining and have discovered that there are two causes. The first is that in the past the assembly of modules of the lining has been poor; once heat penetrates the thickness of the lining it will deteriorate. To avoid this risk, it is necessary to assemble the fibre bodies so that there are no gaps in between, both when the lining is first made and then when it is first exposed to the heat and undergoing shrinkage. Second, and more importantly, no one has, in the past, taken any account of the fact that when the lining is crushed or compressed, the lining is quickly destroyed. Our research suggests that when the lining is crushed, the heat is able to quickly destroy it.

Accordingly, it is one object of this invention to provide a cover having a ceramic fibre lining which will have a long life.

According to one aspect of the invention there is provided a method of heat insulating the opening of a heat chamber, the opening including a peripheral wall, the method comprising applying a cover to the opening, the cover having an inside lining of ceramic fibre arranged in use to contact the peripheral wall and including the step of maintaining the cover in contact with the opening under a load which is sufficient to form a seal with the wall but not sufficient to cause the lining to be crushed.

The invention may be applied to a heat chamber having an opening in any wall. Typically, however, the opening will be in the top (as in the case of a soaking pit) and in this instance the cover is lowered on to the soaking pit and the lining is engaged with the perimeter thereof, and a weight is then applied to the cover so as to subject the lining to a predetermined pressure.

Preferably, the mass of the weight is selected relative to the weight of both the cover and the lining so that the pressure on the lining is substantially less than that which will cause the fibres to be crushed, and is sufficient to allow the cover to rise in the event of an excess of gas pressure within the chamber, and to return the cover back into contact with the perimeter when the excess pressure has been relieved.

In another aspect of the invention, there is provided apparatus for use in heat insulating the opening of a heat chamber, where the opening includes a peripheral wall; the apparatus comprising a cover dimensioned to overlie the opening; the cover having an inside lining of ceramic fibre arranged in use to contact the peripheral wall; and means arranged to apply the cover to the opening under a load which is selected so that the lining in contact with the wall is subjected to a predetermined pressure sufficient to form a seal with the wall but not sufficient to cause the lining to be crushed.

In yet another aspect of the invention there is provided a heat chamber including a cover.

The mass of the weight can be calculated with reference to the pressure to be applied to the surface of the fibres resting on the perimeter surface of the opening. If the weight balances the total weight of the cover and its lining, then the fibres will not make an efficient heat seal. Conversely if no such counter-weight is present, the fibre modules will become crushed and the lining will be of little or no value. As far as we are aware, no one has determined the resistance to crushing of the fibre modules in the direction of the load, and we have done this by applying dead loads to samples of fibre modules to determine how high a pressure can be borne before the module is crushed. We have then determined a load which will compress the fibres in the heat insulating direction, as will be indicated by the calculations below. It must be appreciated, however, that conditions in the pit (or other heat chamber) are not constant. For example, pressure will rise when heating the air therein using burners and occasionally explosions occur. By selecting the load applied to the cover lining, allowance can be made for this variable parameter so that when such an event occurs the cover will lift off to vent the excess gas and then will settle back. In this way, the invention provides a cover having a heat insulating seal possessing the heat insulating benefits of ceramic fibre but with the added benefit of pressure sensitivity.

The way in which the counterweight is applied to the cover will depend on the structure of the soaking pit. If the cover travels on a carriage, then the weight (or weights) may be suspended from the framework associated with the carriage, e.g., using supplementary brackets. Where no carriage is present and the cover is moved in or out of service by means of a crane, an extra framework will be provided near the cover to receive the weight. It should be mentioned that the weight system used in this invention is not intended to raise or lower the cover during its installation or replacement but to adjust the load on the ceramic fibre lining when in contact with the perimeter of the soaking pit.

The heat chamber may be a soaking pit, furnace, oven, ladle, tundish or the like. The lining is preferably secured to the cover in the way described and claimed in patent application GB No. 86,18852 dated Aug. 1, 1986 because that lining is very well assembled. In order that the invention may be well understood it will now be described by way of example with reference to the accompanying diagramatic drawings, in which FIG. 1 is a part sectional view of one embodiment of the invention with the cover on the soaking pit; and FIG. 2 is an enlarged view of a detailed elevation of another cover.

The cover C of FIG. 1 comprises an outer metal frame 1 of I-section beams and dimensioned to overlie a soaking pit of the type installed at a steelworks or mill. The pit has side walls 2 which define at the upper side a perimeter P on which the cover C can rest to form a heat insulating seal. The frame 1 has hooks or the like 4 by which it may be connected to a raising or lowering means such as a crane or it may travel on an overhead carriage 5. The frame 1 supports a mesh plate 6 (FIG. 2) below which is located a layer of heat insulating ceramic fibre F. The fibre may be aluminosilicate or the like.

The layer will typically be made of modules of blocks of fibre F, and may be secured to the plate 6 in a variety of ways. The layer is suspended below the plate 6 by a height of perhaps 30 cm. The cover is dimensioned so that its area is relatively oversized in area compared to that of the soaking pit, so that as shown in FIG. 1, when lowered the fibre layer F of the cover C forms a seal with the perimeter P of the pit (as shown a gasket 3 is present in between). A cable 7 extends from the top of the frame 1 across a support 8 to a weight 9 and is arranged so that when the cover C is lowered, the weight 9 resists a fast or overshoot lowering, and in use prevents undue compression of the fibres of the layer F.

Figure 2:
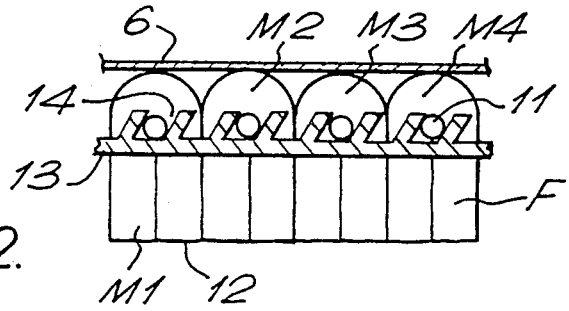

As shown in FIG. 2, the modules, M1, M2, M3, etc., hang down from rods 11 so that the free edges 12 thereof rest on the perimeter P of the soaking pit S. The modules are held together in side-by-side compressed relation so that the lining is tight and there are no heat conductive gaps in the lining. This is achieved by the presence of bars 13 having slots 14 spaced apart longitudinally of the bars by a distance to determine the extent of compression of the modules M1, M2, M3, etc. Preferably, each module is compressed by at least 20%, preferably about 33% of its thickness. The weight 9 determines the extent of compression applied to the modules in the vertical direction as shown, so that a pressure-sensitive seal is formed between the cover C and the soaking pit S.

The invention is illustrated by the following examples:

EXAMPLE 1

A soaking pit measuring 7.2 m long and 2.6 m wide was provided with a cover of the invention. The cover comprised a metal steel fabricated frame having a steel mesh platform and I-section side walls and having a ceramic lining about 28 cm deep as shown in the drawings. Above the pit was a frame for a carriage to move the cover on and off the pit. Brackets were welded alongside the carriage and weights were hung on cables passed over the brackets and connected to the cover. The mass of the weights was calculated according to the desired pressure to be applied to the lining and in the vertical direction as follows:

Assume that the lining is to lie on a 23 cm wide strip around the perimeter of the pit. The available bearing area is thus the linear length of this strip $\times$ width $= 19.50 \times 0.23$ m $= 4.49$ m$^2$.

The weight of the cover and lining is 3855 Kg, giving a pressure on the bearing surface of 8415 Nm$^{-2}$. This was determined empirically to be too high because the lining will be crushed in use.

By applying a counterweight of 3629 Kg, the load applied to the lining is 2214 N and the pressure was 493 Nm$^{-2}$. This can be provided by two counterweights (one at each end of the cover of 1814 Kg). Similarly a counterweight of 1509 Kg gives a pressure of 5120 Nm$^{-2}$, and a counterweight of 2414 Kg gives a pressure of 3145 Nm$^{-2}$.

In this way, it is impossible to determine how large a counterweight to employ which will permit the formation of a heat insulating pressure-sensitive ceramic fibre seal between the cover and the soaking pit. The fibres will form such a seal with the perimeter of the pit and will be compressed along the modules only to the extent necessary to form the seal and not to the extent that under extra pressure, e.g., gas or heat pressure they will be crushed.

A pit was lined with such a cover and the lining was checked regularly. After six months the lining was intact. This was determined visually by the presence or absence of weak points at the cold face of the lining, which was visible at the upper side of the cover. A number of supplementary benefits were determined by the steel mill and are listed as follows:

1. Less heat was required to heat ingots, slabs or blooms in the pit.
2. Because of the efficient heat insulation the environment was pollution-free and more congenial.
3. Because of the efficient heat insulation, adjacent parts were less prone to damage (where pits are arranged in a battery close together it has been observed that heat and flames escaping from one will damage the neighbouring one). Less maintenance was accordingly required.

It will be appreciated that conditions within a heat chamber cannot be kept constant. In the case of a soaking pit furnace, for example, high pressure atmosphere conditions occur during a load heat-up cycle, which may be during high fire or maximum fuel input. The high pressure affects the life of the ceramic fibre lining, because the hot face temperature will penetrate deeper into the lining when pressure is applied to the hot face. A cover of the invention is better able to resist such pressure and keep it away from the lining. In other words, a cover of the invention provides a pressure-resistant thermal seal to the heat chamber. In the evaluation it was observed that an explosion occurred within a soaking pit because of a gas pocket; the cover lifted off the pit and gently returned to its lowered position without any visual damage, whereas, when an ordinary cover is used, the lining and the support structure can be damaged.

What is claimed:

1. A method of heat insulating a heat chamber having an opening bounded by a peripheral wall by means of a cover applied to the opening, the cover having an inside lining of ceramic fiber to contact the peripheral wall and thereby close the opening, the method comprising the steps of:

connecting the cover to a counterweight supported on a frame;

selecting the mass of the counterweight relative to the mass of the cover and the lining such that the pressure between the lining and the peripheral wall is sufficient to form a seal therebetween, but is not sufficient to cause the lining to be crushed; and moving the cover to close the opening.

2. A method according to claim 1, wherein said selecting step is practiced so that the mass of the counterweight relative to that of the cover is such that the pressure between the lining and the wall is substantially less than that which will cause the fibres to be crushed, and is sufficiently low to allow the cover to rise in the event of an excess of gas pressure within the chamber and to gently return the cover into contact with the perimeter wall when the excess gas pressure has been relieved.

3. A method according to claim 1, comprising the further step of causing the cover to travel on a carriage, and the counterweight to be suspended from framework associated with the carriage.

4. A method according to claim 1, wherein the moving step is practiced by causing the cover to be moved in or out of contact with the peripheral wall by means of a crane, and framework is provided near the heat chamber to support the cover and the counterweight.

5. A method according to claim 1, wherein the heat chamber is a soaking pit, furnace, oven, ladle, tundish or the like.

6. A heat chamber cover assembly, comprising:

a heat chamber having an opening bounded by a peripheral wall;

a framework means;

a cover overlying the opening whereby the cover has an inside lining of ceramic fibre in contact with the peripheral wall; and a counterweight connected to the cover and to the framework means, whereby the counterweight is supported by the framework means, and the mass of the counterweight is selected relative to the mass of the cover and the lining such that the pressure between the lining and the peripheral wall is sufficient to form a seal therebetween, but not sufficient to cause the lining to be crushed.

7. A heat chamber cover assembly according to claim 6, wherein the counterweight is connected to the cover by a cable which is suspended from the framework means located above the opening.

8. A heat chamber cover assembly according to claim 6, wherein the framework means allows the counterweight and the cover to be movable such that when gas pressure increases in the heat chamber, the cover may move away from the wall to allow the excess gas pressure to be relieved, and when the excess pressure has been vented to the atmosphere the cover gently returns until the lining is in sealing contact with the wall without the lining substantially being damaged.

* * * * *